US006227888B1

(12) United States Patent
Hahn

(10) Patent No.: US 6,227,888 B1
(45) Date of Patent: May 8, 2001

(54) INTERCHANGEABLE PLUG DEVICE

(75) Inventor: Stan S. Hahn, Moraga, CA (US)

(73) Assignee: Advanced Mobile Solutions, Inc., Moraga, CA (US)

( * ) Notice: Subject to any disclaimer, the term of this patent is extended or adjusted under 35 U.S.C. 154(b) by 0 days.

(21) Appl. No.: 08/821,224

(22) Filed: Mar. 20, 1997

Related U.S. Application Data

(63) Continuation-in-part of application No. 08/414,209, filed on Mar. 30, 1995, now Pat. No. 5,634,806, which is a continuation-in-part of application No. 08/201,397, filed on Feb. 24, 1994, now abandoned.

(51) Int. Cl.[7] ..... H01R 29/00

(52) U.S. Cl. ..... 439/173; 439/172

(58) Field of Search ..... 439/131, 171, 439/172, 173, 174, 928, 929

(56) References Cited

U.S. PATENT DOCUMENTS

| | | | | |
|---|---|---|---|---|
| D. 292,700 | | 11/1987 | Rauch | D13/139 |
| D. 331,220 | | 11/1992 | Tsuchiya | D13/107 |
| D. 350,113 | | 8/1994 | Nagele | D13/110 |
| 1,742,850 | | 1/1930 | Douglas . | |
| 2,490,580 | | 12/1949 | Colla, Jr. | 439/131 |
| 2,538,296 | | 1/1951 | Crocker | 439/131 |
| 3,996,546 | | 12/1976 | Hugly | 336/107 |
| 4,191,917 | | 3/1980 | Brown et al. | 439/173 |
| 4,518,212 | | 5/1985 | Rumble | 439/221 |
| 4,543,624 | | 9/1985 | Rumble | 439/173 |
| 4,571,717 | | 2/1986 | Reichel et al. | 369/256 |
| 4,626,052 | | 12/1986 | Rumble | 439/173 |
| 4,743,829 | | 5/1988 | Fenne et al. | 439/131 |
| 4,776,814 | | 10/1988 | Geurts | 439/694 |
| 4,815,983 | | 3/1989 | Erickson et al. | 439/173 |
| 4,911,649 | | 3/1990 | Helmich, Jr. | 439/172 |
| 4,922,178 | | 5/1990 | Matuszewski et al. | 320/2 |
| 4,973,827 | * | 11/1990 | Nozaki | 439/173 X |
| 4,997,381 | * | 3/1991 | Oh | 439/131 |
| 5,106,317 | | 4/1992 | Taylor | 439/173 |
| 5,159,545 | | 10/1992 | Lee | 439/173 |
| 5,160,879 | | 11/1992 | Tortola et al. | 320/2 |
| 5,213,516 | | 5/1993 | Okamoto | 439/171 |
| 5,324,214 | | 6/1994 | De Castro | 439/621 |
| 5,423,690 | | 6/1995 | Selker et al. | 439/172 |
| 5,577,923 | * | 11/1996 | Lee | 439/518 X |
| 5,613,863 | | 3/1997 | Klaus . | |
| 5,616,051 | * | 4/1997 | Rogers et al. | 439/171 X |
| 5,634,806 | | 6/1997 | Hahn | 439/173 |

* cited by examiner

*Primary Examiner*—Paula Bradley
*Assistant Examiner*—Daniel Wittels
(74) *Attorney, Agent, or Firm*—J. William Wigert, Jr.; Crosby, Heafey, Roach and May

(57) ABSTRACT

An interchangeable plug device includes an electrical plug detachably mountable to a casing and movable between a detached and an operative position relative to the casing, and a releasable locking mechanism integral with the electrical plug to maintain the plug in an operative position. The locking mechanism can be released by a user to allow the plug to be moved to the detached position. A preferred form of locking mechanism is a depressible lock bar connected to or integral with an electrical plug body, which is designed to engage a detent in a casing. A preferred form of electrical connection between the plug and any casing comprises a submerged pin and sleeve configuration to protect the user or passerby from electric shock if the plug is detached from its operative position but remains a source of live current. A variety of interchangeable electrical plugs can preferably be fitted to the same casing.

6 Claims, 10 Drawing Sheets

INTERCHANGEABLE PLUG DEVICE

This application is a continuation-in-part of U.S. patent application Ser. No. 08/414,209, filed Mar. 30, 1995, now U.S. Pat. No. 5,634,806 which is a continuation-in-part of U.S. patent application Ser. No. 08/201,397, filed Feb. 24, 1994 now abandoned.

FIELD OF THE INVENTION

The present invention relates generally to plug mechanisms compatible with a variety of electronic devices, and more particularly to interchangeable plug mechanisms which can be detached from electronic devices for convenient transportation or storage and also can be interchanged for use with different sockets used in various parts of the world.

BACKGROUND OF THE INVENTION

People rely heavily on a wide variety of electrical devices. Almost all of these devices draw power ultimately delivered to the user through a wall outlet or socket. While many electrical devices are sold for use throughout the world, there is no world standard for electrical plug and socket configurations, size, shape, position or number of prongs. The wide variety of socket configurations in use worldwide burdens international suppliers of products to varied countries and international travelers who wish to use electrical devices in varied locations.

Differences exist in both supply current and physical socket configuration characteristics. Most industrial nations use a standardized alternating current supply socket with a hot side and a neutral side. Some plugs and sockets specifically incorporate a third earth or ground lead while others do not. There is no world standard for power supply voltage or frequency. Voltage can vary from 100 to 240 volts. Frequency can vary from 50 to 60 cycles per second (hertz).

Fortunately, many electronic devices, and essentially all battery powered electrical devices, ultimately run on direct current, so a "universal" power supply that converts 100–240 volts AC at 50–60 hertz into a direct current suitable for a particular application is well known in the art. However, a problem remains with physically accessing an AC current source supplied through any number of socket configurations.

Differing plug configurations have posed a problem to manufacturers who sell equivalent products into various parts of the world. The need for plug diversity is also a significant problem for people who travel to different parts of the world and need to take electrical devices with them, such as hair dryers, electronic cameras, phones or computers.

The traditional solution for the mechanical configuration problem is to provide adapters including a socket to accommodate the prongs of the desired electrical device integrated with a second set of prongs in a configuration for a local socket. These adapters suffer from some significant problems. The most important is that the adapters are bulky and at a minimum cause the prongs of the original device to be extended by at least the length of the additional set of prongs. Since most plug devices are designed to be secured by spring tension and interaction with a wall plug, this can pose a significant mechanical disadvantage. The increased lever arm created by the additional prong length will tend to shift the plug downward, tending to pry the plug out of the wall socket. This will be true even for a light weight plug.

The lever arm problem is accentuated with devices that are larger than a simple plug. Many battery chargers or power supplies are designed to be wall-mounted at a wall socket. A typical device includes a casing which terminates in a plug designed to plug directly into the wall socket. The casing is often designed to lie against a wall to provide mechanical stability and to maintain the plug prongs in proper contact with the wall socket. If an adapter must be used, the unit loses the stability of resting against the wall and, because even a small amount of weight at the end of a lever arm will create a torque which will tend to pry the prongs out of the wall socket, such a plug adapter is generally unusable for such wall-mounted plug-in devices.

Angling the plug severely can compromise the electrical connection to the point that the plug no longer is in electrical contact with source current. This type of angling may lead to partial separation from the wall socket and may expose the prongs of the plug in such a way that a person or animal might come into contact with live current, thereby causing bodily harm.

A further problem with existing plugs is the awkward shape of the plug with prongs protruding from the end. If, for example, a plug is moved from one location to another, the prongs of the plug extend outward and can be difficult to pack or store or can catch on clothing when packed into a travel case.

A few plug devices have been designed with a plug or prongs which fold into a casing. For example, some rechargeable flashlights include the collapsible prongs which can be rotated into a position extending out from the body of the flashlight and plugged directly into a wall socket or extension cord. Some telephone charging stations include a cradle for the telephone and a rotatable plug which can be extended into position for plugging into a wall socket, or collapsed into a space in the shell of the charging station, particularly so that a user may slip a charging station into a pocket, a briefcase, or other container. However, these devices still depend on adapters for use world-wide.

Presently available collapsible plug devices suffer from various problems which make them inconvenient or even dangerous to use. In particular, the rotatable plug has only a weak spring holding the plug in position. It does not take much effort to collapse the plug, which may cause the plug to partially or completely pull out of a wall socket. This can compromise the electrical connection to the point that the plug no longer is in electrical contact with source current. In some circumstances, this may expose the prongs of the plug in such a way that a person, might come into contact with live current, thereby causing bodily harm. In addition, a collapsing plug might pinch the user.

The present invention overcomes these problems by providing an interchangeable and/or collapsible plug device, which can be securely maintained in a connected position relative to a device casing, and can be easily separated and, if desired, folded to a compact, collapsed position. The collapsible prong feature can be incorporated within an interchangeable plug device which can be designed for use in a variety of plug configurations and still provide the mechanical advantages of fitting closely to the socket and, generally, against a wall. Moreover, the inventive device provides a safe means for deriving current from an interchangeable plug while minimizing the risk of exposure to a live prong or connector.

SUMMARY OF THE INVENTION

To address the shortcomings of available plug devices, the present invention provides an interchangeable electrical plug detachably mountable to a casing and moveable between a detached and an operative position relative to the casing, the electrical plug comprising a plurality of prongs in electrical communication with an electrical device when mounted to the casing, a releasable locking means to maintain said electrical plug in said operative position, whereby said electrical plug is locked into the operative position until and unless the releasable locking means is released, and an electrical contact recessed with said electrical plug for preventing inadvertent contact therewith when said electrical plug is in said detached position.

Accordingly, it is an object of this invention to provide an interchangeable electrical plug device.

Another object of this invention is to provide a releasable locking means so that a user can readily release the locking mechanism and move the plug from an operative to a detached position relative to the casing.

A further object of this invention is to provide a means for securing and electrically connecting an interchangeable plug device with a compatible carrier in a manner which provides optimal user safety.

Still another object of this invention is to provide an interchangeable plug with collapsible prongs which can be maintained in an extended position.

Yet another object of this invention is to provide a releasable securing means for the extended prongs so that a user can readily release the securing mechanism and move the prongs from an extended to a collapsed position.

BRIEF DESCRIPTION OF THE DRAWINGS

The aforementioned advantages of the present invention as well as additional advantages thereof will be more clearly understood hereinafter as a result of a detailed description of a preferred embodiment of the invention when taken in conjunction with the following drawings in which.

DESCRIPTION OF THE PREFERRED EMBODIMENTS

The interchangeable plug of this invention include a plug mountable to a casing, a locking device and a recessed electrical contact for placing the plug and an electrical device in electrical communication with one another. The specific shape of the casing can be modified in many ways to accommodate specific design needs. The plug can also be modified to accommodate specific design needs, including the number and configuration of electrical prongs to adapt to a variety of standard, electrical outlets. The drawings illustrate a representative device but one skilled in the art will recognize that a variety of devices can be designed and manufactured, which are encompassed by the teachings of this invention.

Figure 1A:
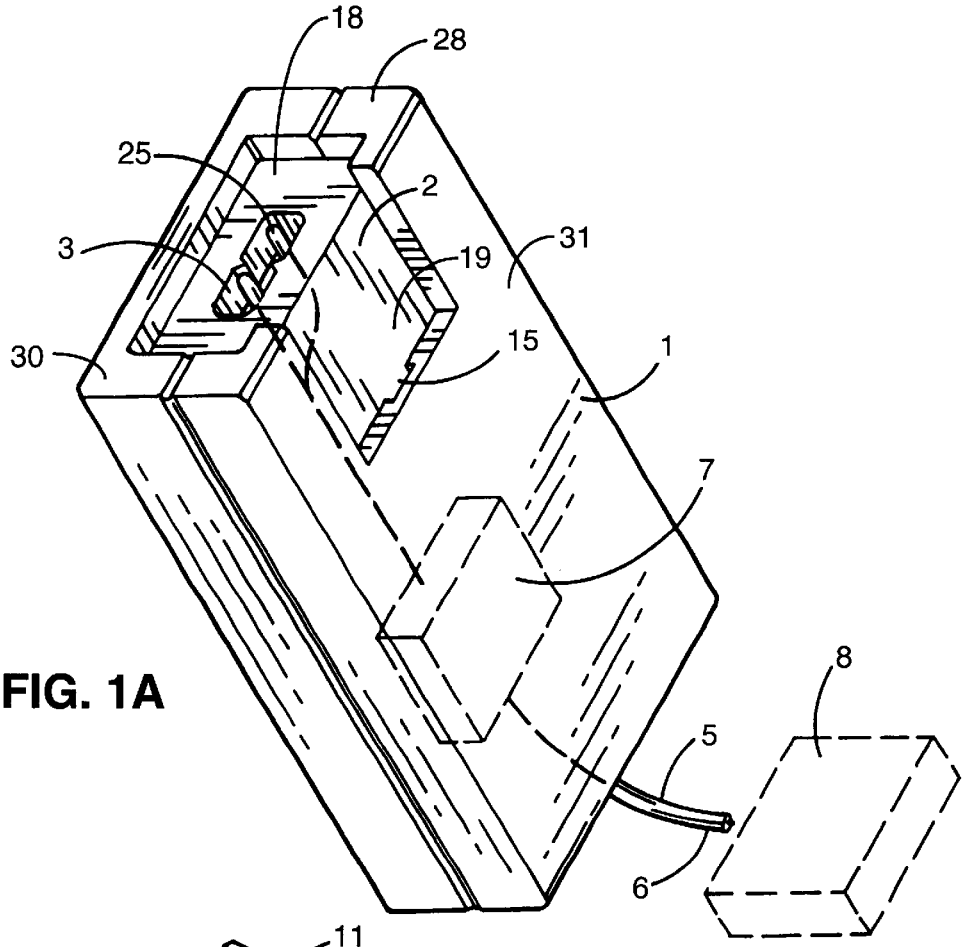
FIGS. 1A, 1B, 1C, 1D and 1E illustrate a perspective view of the interchangeable plug device showing several interchangeable plugs positioned to be moved to an operative position.
Figure 1B:
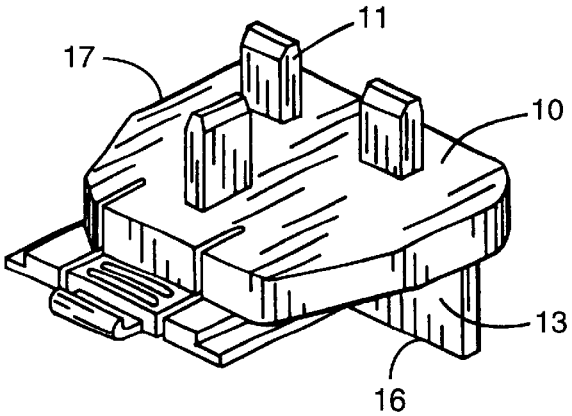
Figure 1C:
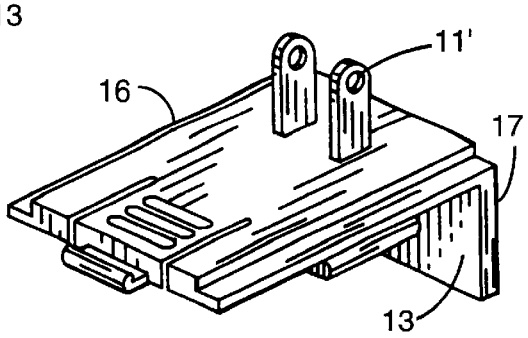
Figure 1D:
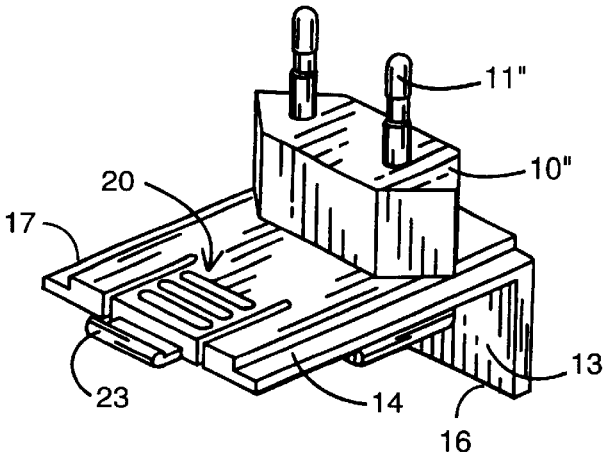
Figure 1E:
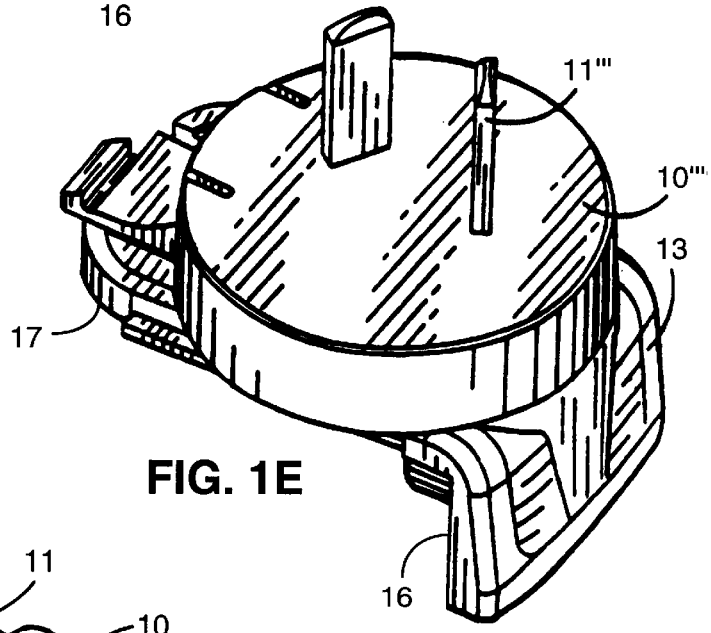
Figure 3:
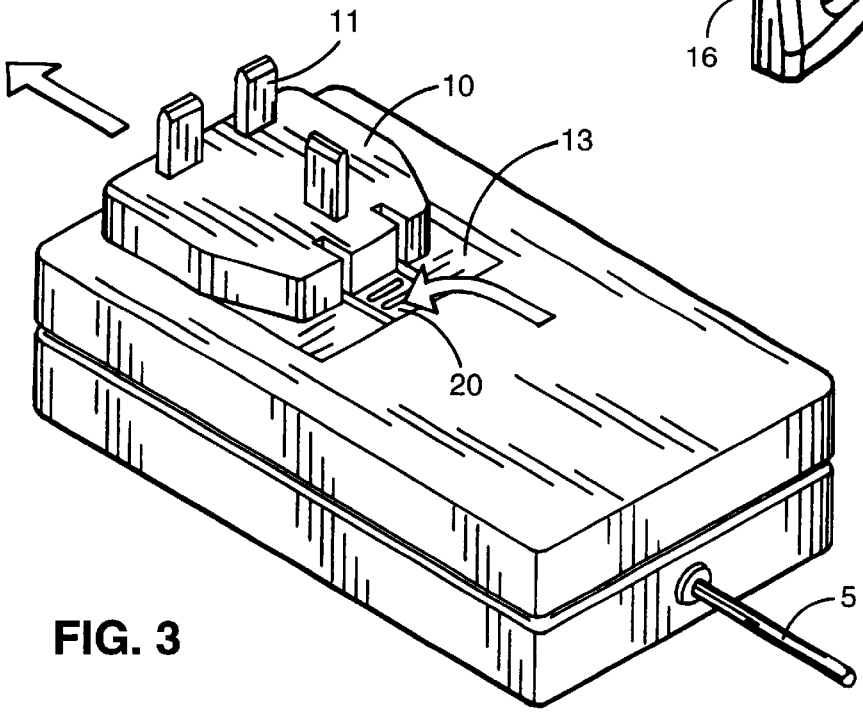
FIG. 3 illustrates a perspective view of the interchangeable plug showing a representative interchangeable plug in an operative position.
Figure 2A:
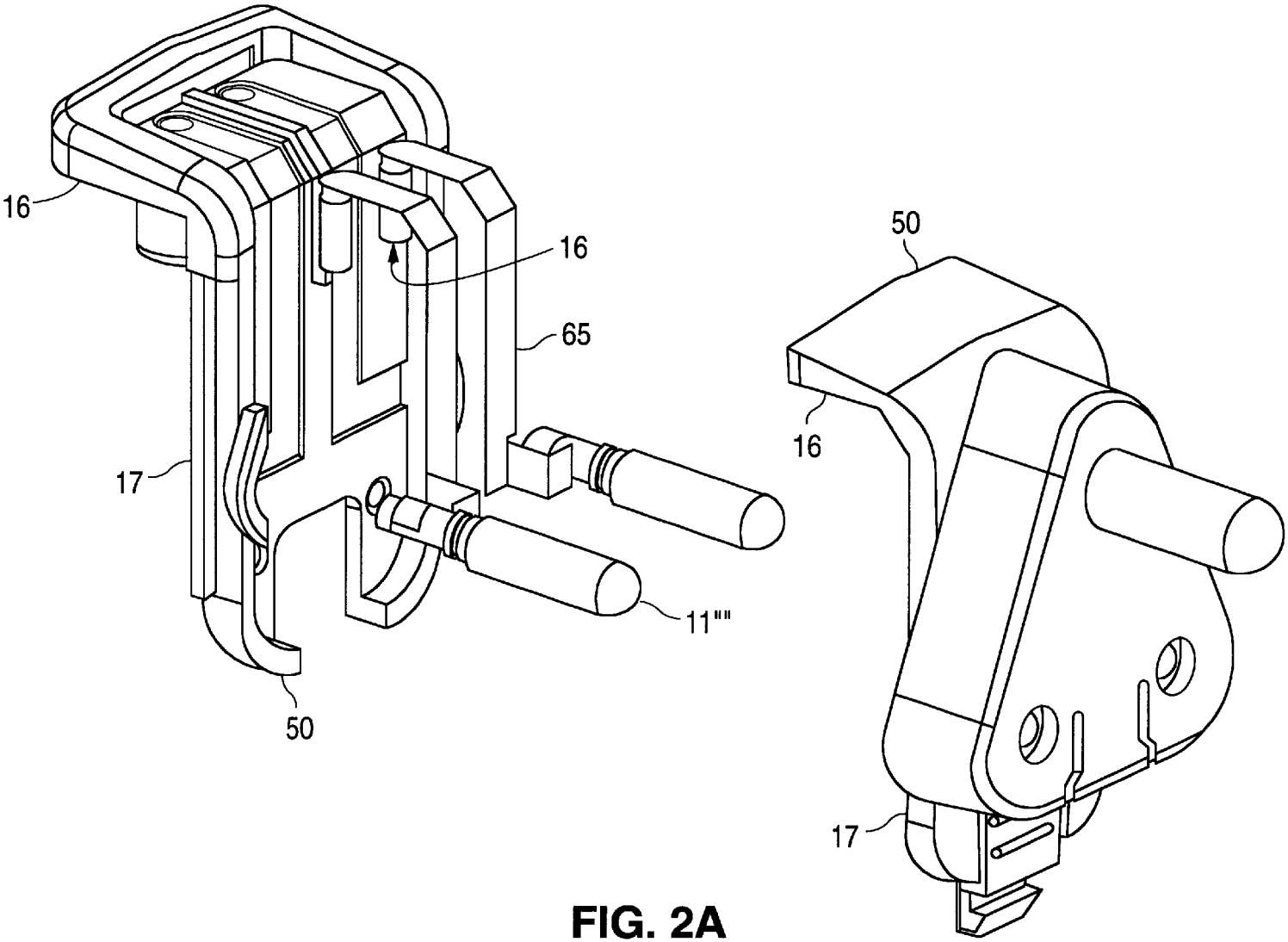
FIGS. 2A, 2B, 2C, 2D, and 2E illustrate exploded views of the various embodiments of the inventive interchangeable plug.
Figure 2B:
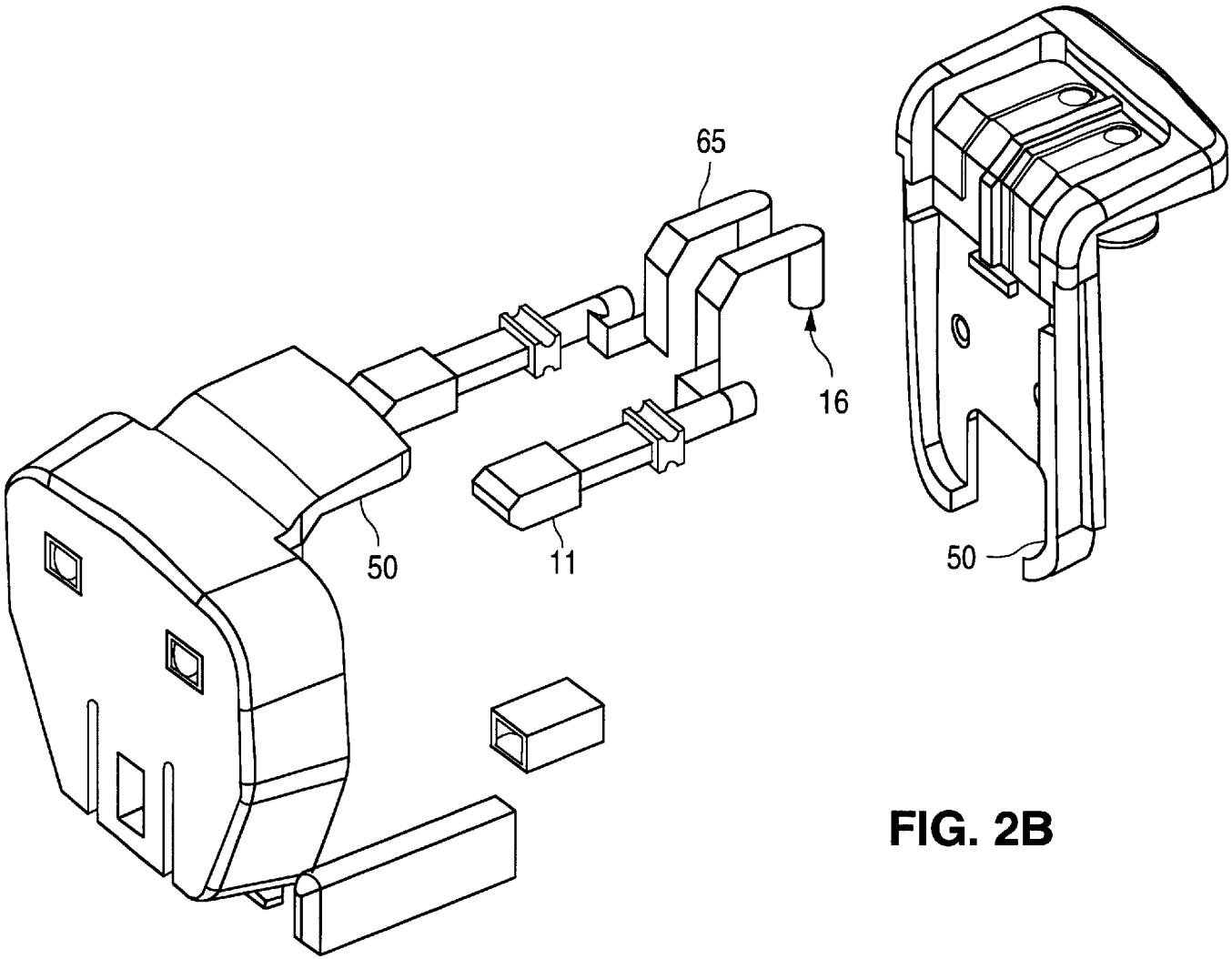
Figure 2C:
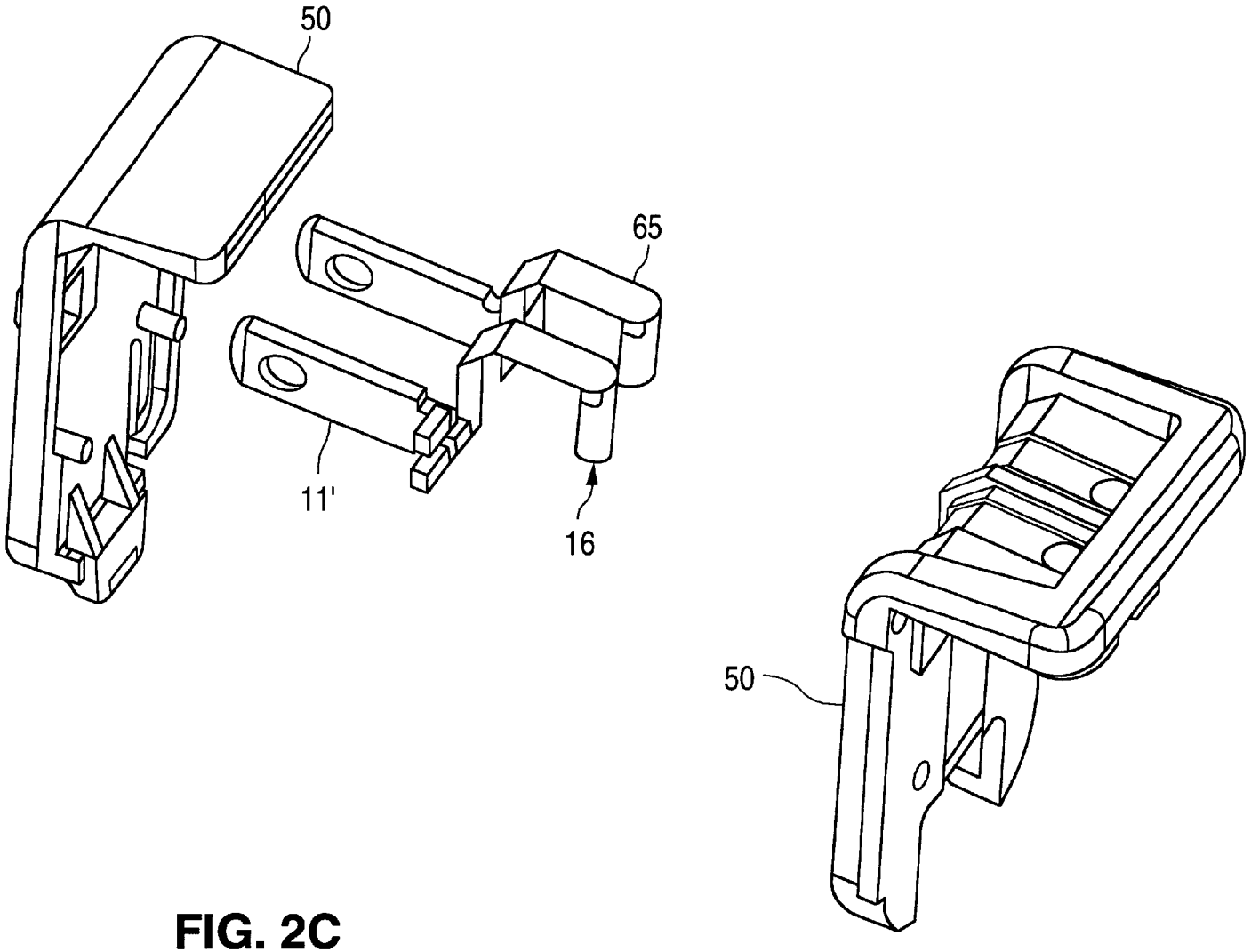
Figure 2D:
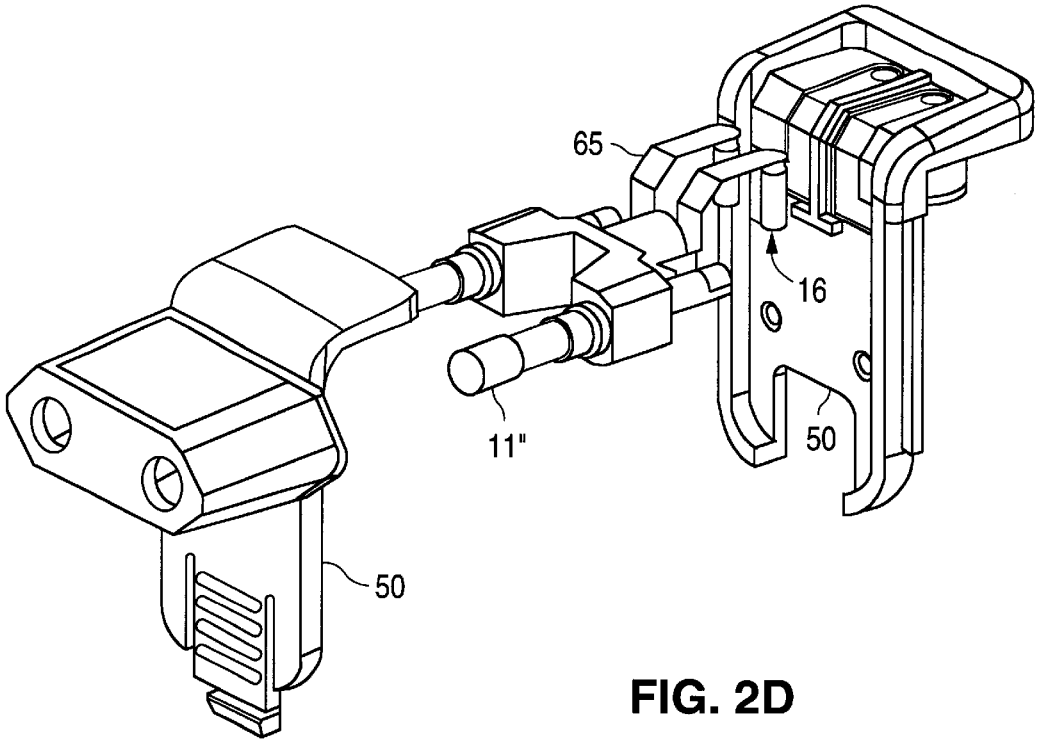
Figure 2E:
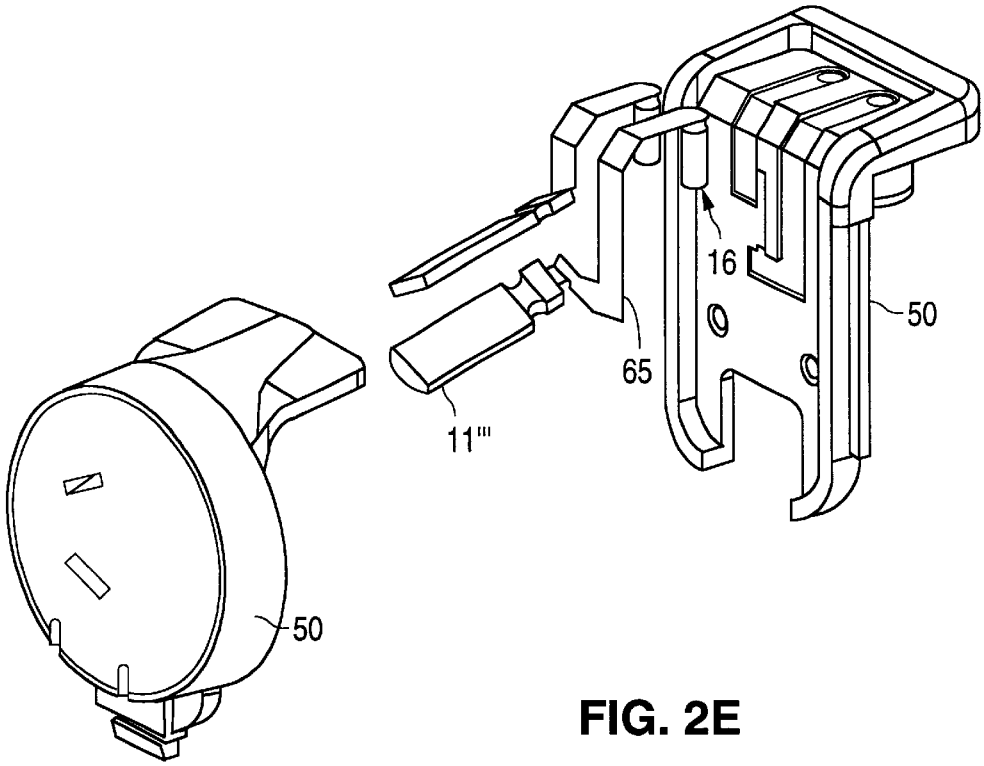

Referring to FIGS. 1A, 1B, 1C, 1D and 1E, casing 1 includes cavity 2 with channels 28 which are designed to accommodate any one of the carriers 13 depicted in the Figures with tongues 14. Similarly, opening 3 with submerged conducting pins 25 are designed to accommodate conducting sleeves 16. In the description and claims which follow, carriers 13 and tongues 14 may also be referred to as "plates". In a preferred embodiment, casing 1 is made of high impact thermoplastic material, with top and bottom halves which can be sealed together with ultrasonic bonding. Carrier 13 shown in FIG. 1*b* has a body 10 which supports a plurality of prongs 11. Carrier 13 shown in FIG. 1*c* has only two prongs 11' of a different shape from prongs 11 of FIG. 1*b*. Similarly, FIG. 1*d* shows a carrier 13 with a body 10" and cylindrical prongs 11" and FIG. 1*e* shows a carrier with a body 10'" with a different style of prongs 11'".

As shown in FIGS. 1*b*, 1*c*, 1*d*, and 1*e*, each of the carriers 13 is "L" shaped or "el" shaped, having a short leg 16 and a long leg 17. The short leg 16 of each carrier 13 is dimensioned to be snugly received in a first recess 18 in a first planar surface 30 in casing 1 and the long leg 17 of each carrier is dimensioned to be snugly received in a second recess 19 in a second recess 31 in casing 1. The second recess 31 is generally perpendicular to the first recess 30.

FIGS. 2A, 2B, 2C, 2D, and 2E provide exploded views of various embodiments of the inventive interchangeable plug. Cover plates 50 are aligned and, preferably, ultrasonically bonded or otherwise fastened together to form carrier 13. Conductors 65 lead at one end to prongs 11 and at the other end to to conducting sleeves 16, illustrated in greater detail in FIGS. 4A and 5. This highly modular design allows for greater economies of scale when manufacturing the inventive interchangeable plugs.

Figure 5:
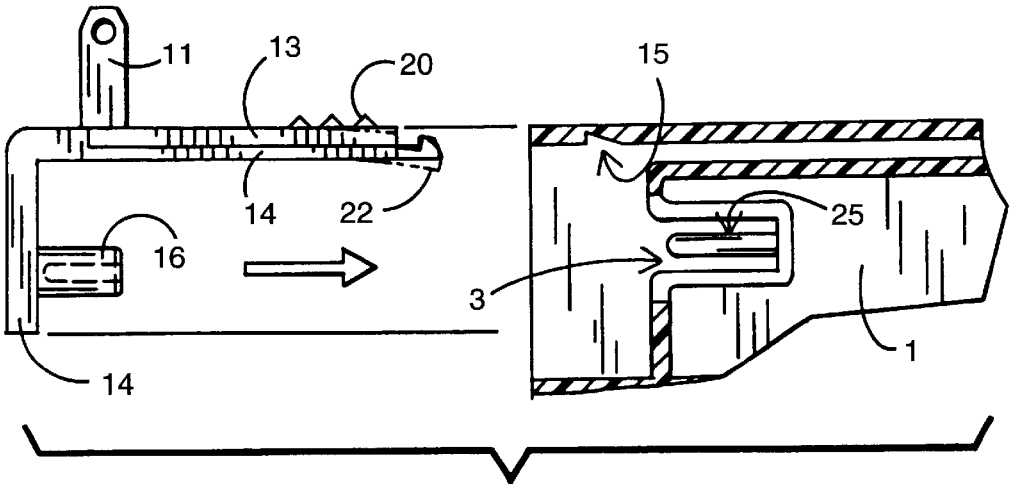
FIG. 5 illustrates a cross-section of the device, showing the plug body and carrier ready to be connected to the device.

Referring to FIG. 5, carrier 13 is connected to or integral with prongs 11. Each conducting sleeve 16 within carrier 13 is electrically connected to one prong 11 and is designed to mate with a corresponding conducting pin 25 positioned in cavity 3. The conducting pin/sleeve configuration for the electrical contacts of the preferred embodiment increases the safety of the interchangeable plug design by making user contact with a live contact highly unlikely.

In one embodiment, shown in FIG. 1A, power supply 7 is connected to conducting pins 25 and also through electrical cable 5 to an electrical connection means such as power adapter plug 6, which can in turn be connected to an electronic device 8.

FIG. 5 illustrates a cutaway view of a preferred embodiment of the new device. Carrier 13 is a generally rectangular element with a tongue 14 along each of two sides. Detent 15, shown in greater detail in FIG. 4A, is cut into casing 1.

Figure 4A:
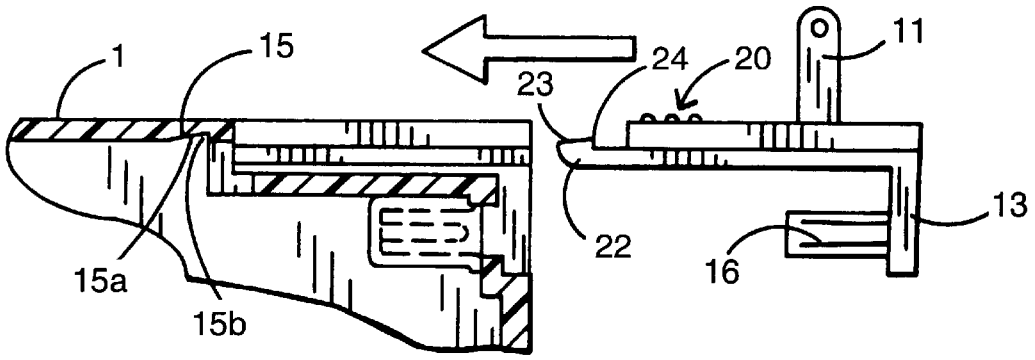
FIGS. 4A, 4B and 4C illustrate a cross-section of the device, showing the plug body and carrier ready to be connected to the device (4A), connected (4B) and released and ready to be detached (4C)
Figure 4B:
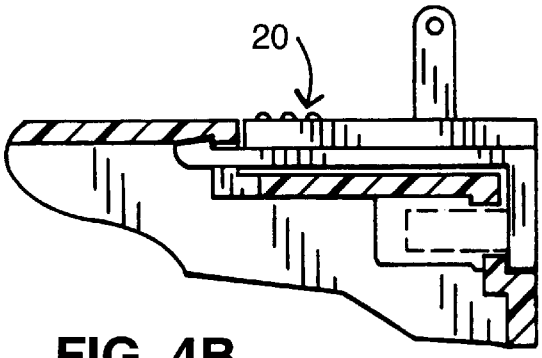
Figure 4C:
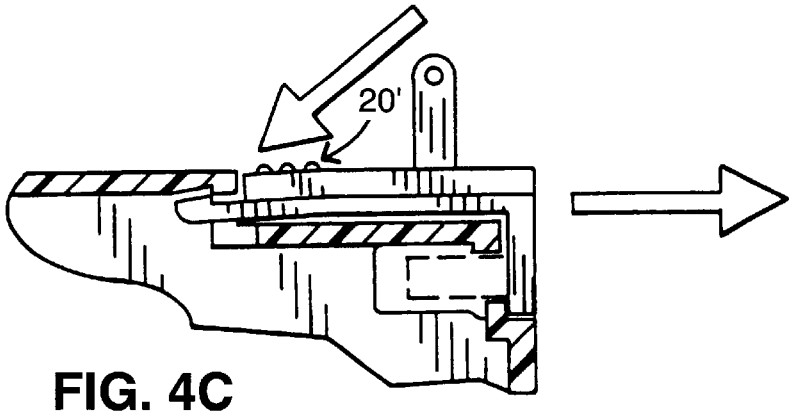

FIGS. 4A, 4B and 4C show lock bar 22 deformably positioned on carrier 13. Lock bar 22 is made of a suitable material, such as a plastic material, which is resilient, tends to return to a preferred position, and can be secured at one end and be bent repeatedly to perform the needed release function yet return to a resting position with enough tension to perform the needed latch function. Lock bar 22 is preferably formed integral with carrier 13 and more specifically is integral with tongues 14. Release button 20 is connected to or preferably integral with lock bar 22. Lock bar 22 includes latch 23 and latch tip 24, which are designed to engage detent 15 in casing 1. In an alternative embodiment, the lock bar, detent and latching mechanisms could switch positions relative to the casing and carrier.

When carrier 13 and casing 1 are integrated into a singular unit, lock bar 22 is pressed against casing 1 by the natural tension and resilience of lock bar 22. To release the carrier 13 from the casing 1, release button 20 is depressed, which moves lock bar 22 away from casing 1 and latch 23 and latch 24 away from detent 15. Carrier 13 can then be disengaged from casing 1.

Detent 15 is shaped to accommodate the configuration of latch 23 and latch tip 24. In a preferred embodiment, latch 23 is angled as shown to provide a conventional catch mechanism.

Detent 15 includes base 15A which may be generally flat or angled to accommodate latch 23. Detent 15 also includes side 15B which is designed to accommodate and mechanically couple with latch 23 and latch tip 24. Detent 15 may, instead, have two parallel sides on either side of base 15A.

The pressure of lock bar 22 against casing 1 at detent 15 will maintain carrier 13 in the operative position until a user activates release button 20, moving it from the resting position shown in FIG. 4B to a released (depressed) position 20' shown in FIG. 4C. Once the release button is moved and latch tip 24 is removed from detent 15 at least far enough so that carrier 13 can slide freely, the user can move carrier 13 away from casing 1. Although conducting sleeves 16 shown in FIG. 5 may remain hot electrical leads after carrier 13 is removed, a user or passerby is protected from inadvertent contact with the conducting pins by their submerged position relative to the carrier 13.

Collapsible Prong Plug Feature

Figure 6:
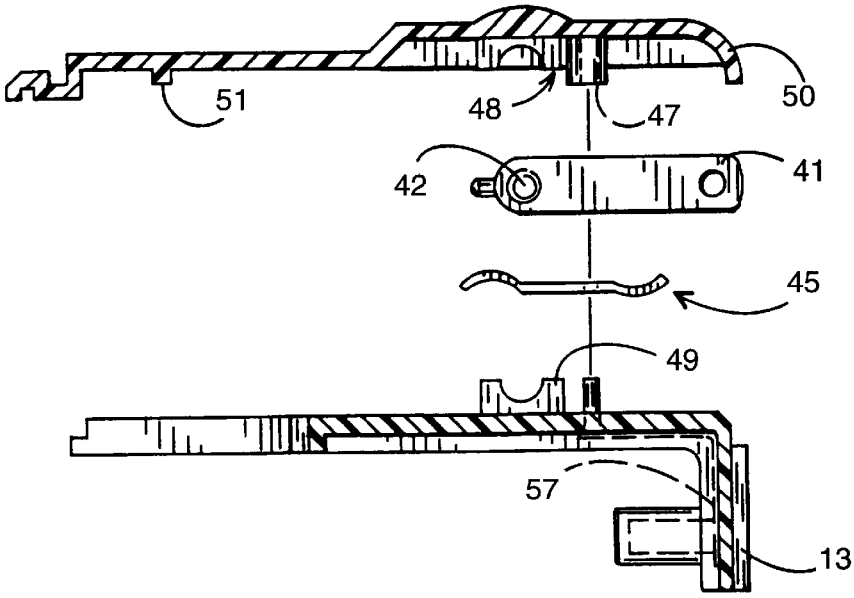
FIG. 6 is an exploded view of a preferred embodiment of the present invention including the collapsible prong feature.
Figure 7:
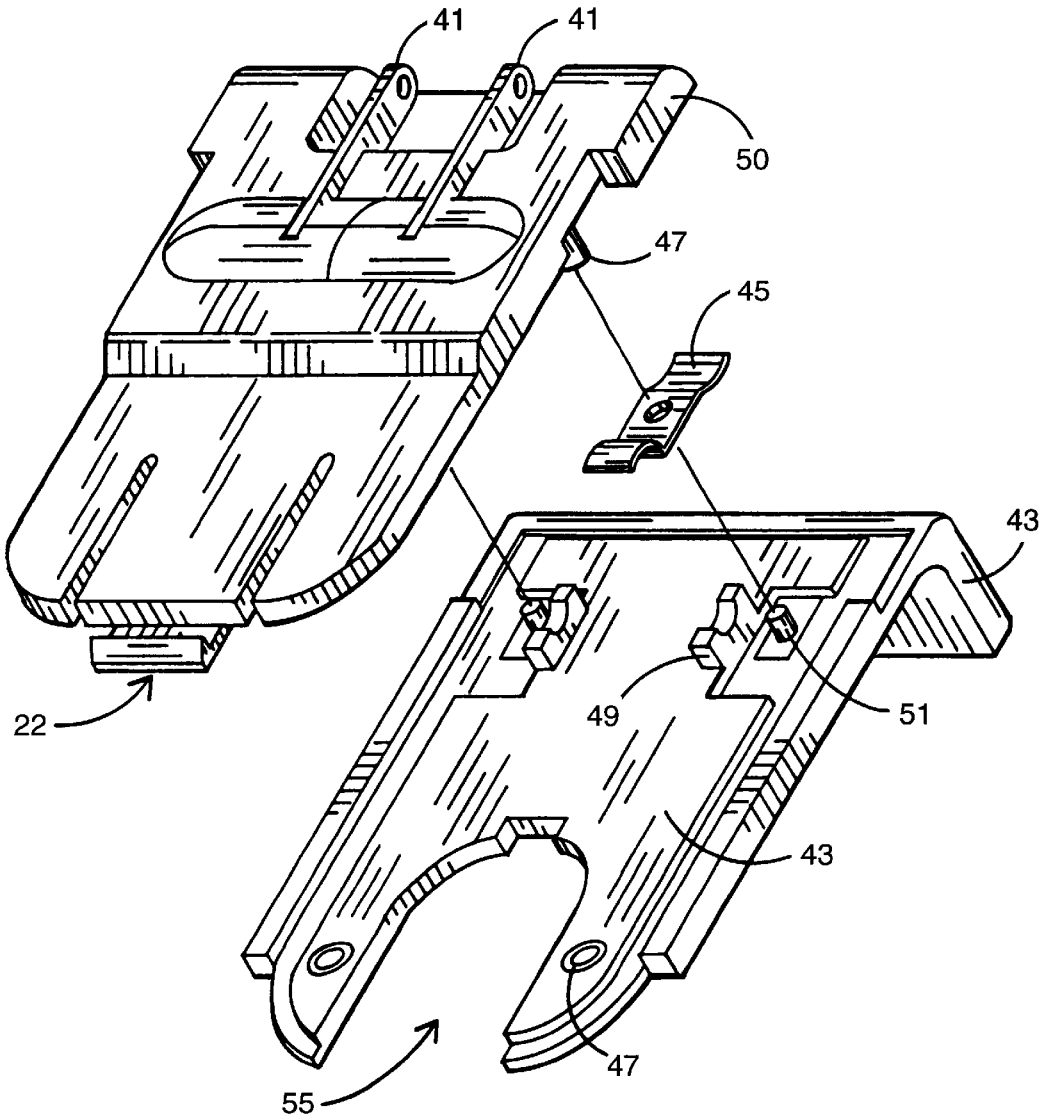
FIG. 7 is a side exploded view of the collapsible prong feature of the present invention.

The collapsible prong plug feature of this invention includes a securing means and a release mechanism integrated into the carrier. The prongs can be modified to accommodate specific design needs, including the number and configuration of electrical prongs to adapt to a variety of standard electrical outlets. FIGS. 6, 7 and 8 illustrate a representative device, but one skilled in the art will recognize that a variety of devices can be designed and manufactured which are encompassed by the teachings of this invention.

Referring to FIG. 6, an exploded view of carrier 13 including the collapsible prong feature of the present invention is shown. Cover plate 50 including lock bar 22 integrally formed therewith, is connected to carrier 13. Encased between cover plate 50 and carrier 13 are collapsible prongs 41 integral with pivot pin 42. Pivot pin 42 rests between upper half-axis 48 and lower half-axis 49. Securing contact springs 45 sit between collapsible prongs 41 and carrier 13. There is preferably at least one securing contact spring for each prong 41. Thus, for the embodiment shown there are two securing contact springs 45.

FIG. 7 provides a more detailed exploded view of the present invention. Male connectors 51 are designed to mate with female connectors 47 in cover plate 50. Securing contact springs 45 preferably fit around male securing members 51 and are thereby secured into position by downward pressure applied from cover plate 50 via female connecting members 47. Gap 55 is formed in carrier 13 to accommodate movement of integral lock bar 22 in cover plate 50.

Figure 8A:
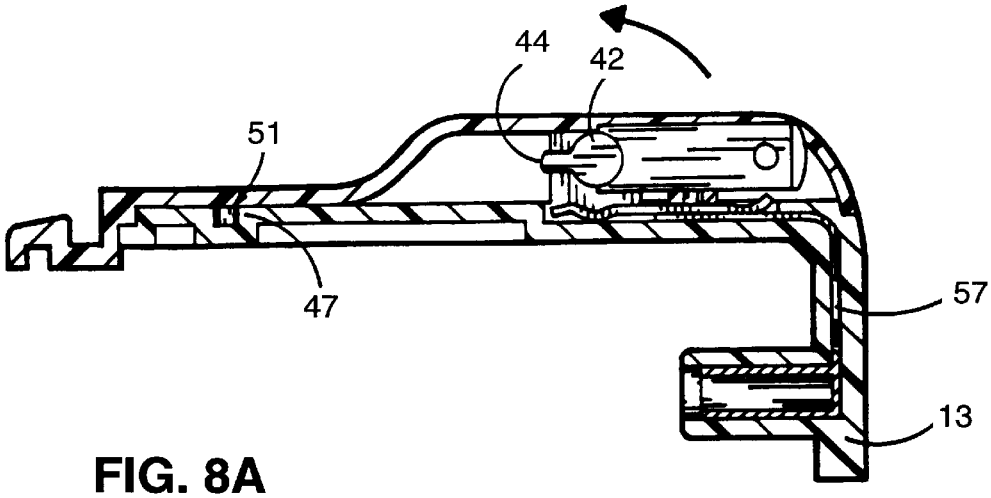
FIGS. 8A, 8B and 8C illustrate a cross-section of the device showing the plug body and carrier with the prongs in a fully collapsed position (8A), partially extended position (8B), and fully extended position (8C).
Figure 8B:
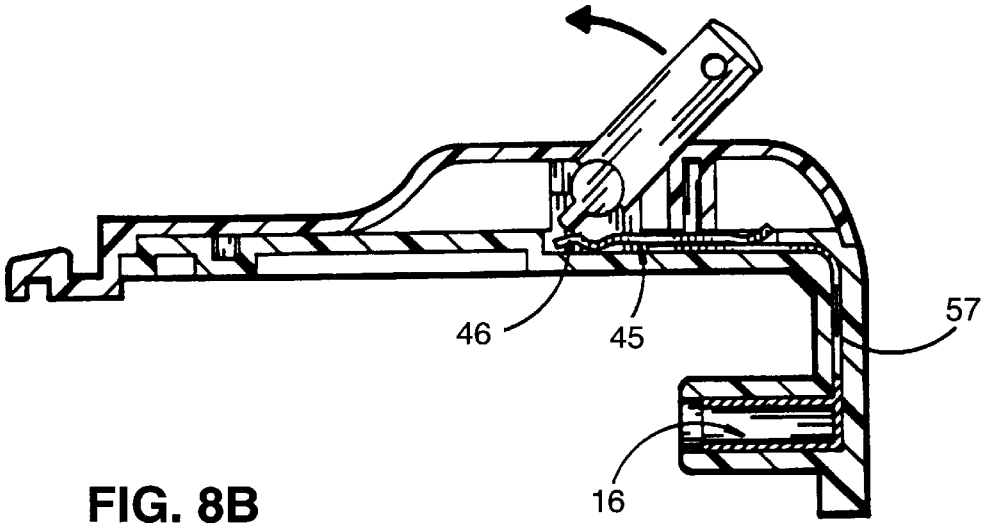
Figure 8C:
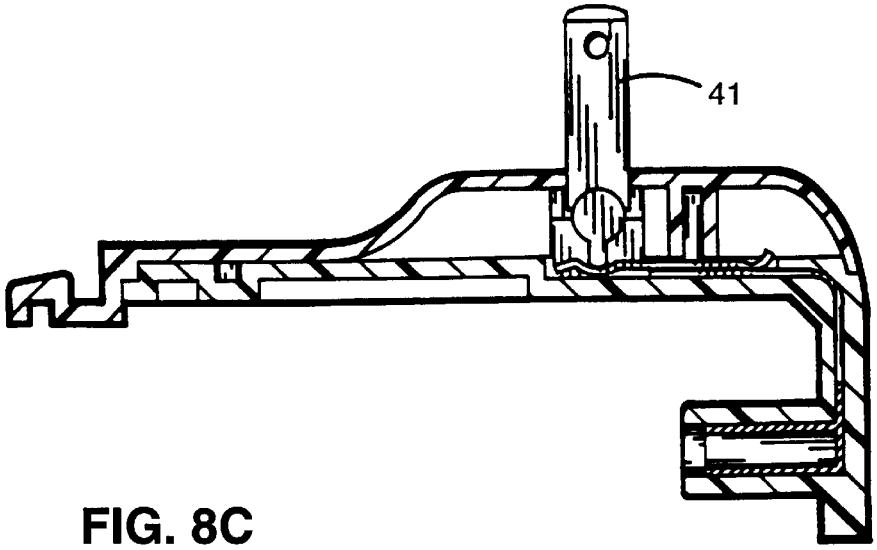

FIGS. 8A, 8B and 8C illustrate cut-away, side views of a preferred embodiment of the new device. Carrier 13 includes connecting line 57 attaching conducting sleeves 16 to each of collapsible prongs 41. Note that each of the sleeves 16 is encased in the carrier 13, which is made of insulative material, so that each sleeve 16 is substantially shielded along its length in a substantially nonconductive jacket having an opening at one end to permit engagement with one of the conducting pins 25. Collapsible prongs 41 are integrally formed with pivot pin 42. Also integral with pivot pin 42, cans 44 provide an offset force when the prongs are extended. Referring to FIG. 8B, as collapsible prongs 41 are raised, cams 44 engage rises 46 in securing contact springs 45, thereby causing a frictional force to resist the upward motion of the collapsible prongs. As collapsible prongs 41 reach their full upright and extended position, cams 44 pass completely over rises 46 and are engaged within securing contact spring 45. An unbroken electrical connection is thereby created from collapsible prongs 41 through cams 44 to securing contact springs 42 to wires 57 and to conducting sleeves 66.

If desired, a single cam could be placed on pivot pin 41 with a single securing contact spring 45 positioned nearby to provide resistance via rise 46 and electrical contact with conducting sleeves 66.

A typical collapsible prong plug includes two or three prongs 41. The figures illustrate a typical American plug, but the same teachings and principles can be applied to design and use collapsible prong plug devices for British, European or other plugs, as illustrated in FIG. 1.

The pressure of securing contact springs 45 will maintain collapsible prongs 41 in the extended position until a user forces the prongs from the extended position shown in FIG. 8C to the collapsed position shown in FIG. 8A. The user must apply sufficient force to move each cam 44 over rise 46, thereby increasing the resistant force of each securing contact spring 45. As cams 44 of prongs 41 disengage securing contact springs 45, electrical contact is broken. Once the cams 44 have passed rises 46 and are free of securing contact springs 45, the user can move prongs 41 to the collapsed position.

Thus, the preferred embodiment of the present invention incorporates the collapsible prong feature into an interchangeable plug incorporating a submerged pin and sleeve electrical connection. With this combination, the present invention provides an improved apparatus and method for deriving electrical current from an outlet meeting any national or international standard, while providing the increased safety and convenience of an easily stored and transported device.

A general description of the device and method of using the present invention as well as a preferred embodiment of the present invention has been set forth above. One skilled in the art will recognize and be able to practice many changes in many aspects of the device and method described above, including variations which fall within the teachings of this invention. The spirit and scope of the invention should be limited only as set forth in the claims which follow.

What is claimed is:

1. An interchangeable plug device comprising an electrical plug for detachable connection to a casing, the electrical plug having an "L" shape with a short leg and a long leg, the short leg being dimensioned to be snugly received in a first recess in a first planar surface of the casing and the long leg being dimensioned to be snugly received in a second recess in a second planar surface of the casing, at right angles to the first planar surface, when the electrical plug is attached to the casing, and including:

a plurality of electrically conductive prongs extending from the long leg, each of the prongs being intended to be inserted in a wall socket for receiving electrical power therefrom;

a plurality of socket members projecting from the short leg and oriented to mate with and receive separate ones of male contacts positioned in the first recess of the casing when the electrical plug is attached to the casing, each of the socket members being electrically connected to a separate prong so that when the electrical plug is attached to the casing the prongs are electrically connected through the socket members to the male contacts, and a releasable locking mechanism for locking the electrical plug to the casing.

2. The interchangeable plug device according to claim 1, wherein the releasable locking mechanism comprises:

a releasable latch member resiliently formed as part of the long leg for engagement with a locking detent formed in the second planar surface of the casing near the portion of the second recess farthest from the first planar surface when the electrical plug is attached to the casing to maintain the electrical plug attached to the casing, whereby the electrical plug can be locked into attachment with the casing until and unless a user releases the releasable latch member from engagement with the locking detent by depressing the releasable latch toward the casing.

3. An interchangeable plug device comprising (a) a device casing having at least a first planar surface and a second planar surface which meet at a right angle, the device casing including:

a first recess in the first planar surface and at least a pair of male contacts extending outward in the direction of an opening in the first recess, the male contacts being electrically connected to circuitry contained within the casing, and a second recess in the second planar surface, the first recess and the second recess being in communication with each other;

(b) an electrical plug for detachable connection to the casing, the electrical plug having an "L" shape with a short leg and a long leg, the short leg being dimensioned to be snugly received in the first recess and the long leg being dimensioned to be snugly received in the second recess when the electrical plug is attached to the casing, and including:

a plurality of electrically conductive prongs extending from the long leg, each of the prongs being intended to be inserted in a wall socket for receiving electrical power therefrom;

a plurality of socket members projecting from the short leg and oriented to mate with and receive separate ones of the male contacts when the electrical plug is attached to the casing, each of the socket members being electrically connected to a separate prong so that when the electrical plug is attached to the casing the prongs are electrically connected through the socket members to the male contacts; and (c) a releasable locking mechanism for locking the electrical plug to the casing.

4. The interchangeable plug device according to claim 2, wherein the releasable locking mechanism comprises:

a locking detent formed in the second planar surface near the portion of the second recess farthest from the first planar surface;

a releasable latch member resiliently formed as part of the long leg for engagement with the locking detent when the electrical plug is attached to the casing to maintain the electrical plug attached to the casing, whereby the electrical plug can be locked into attachment with the casing until and unless a user releases the releasable latch member from engagement with the locking detent by depressing the releasable latch toward the casing.

5. An interchangeable plug device according to claim 2, wherein the device casing houses a battery charger and the male contacts are electrically connected to the battery charger.

6. An interchangeable plug device according to claim 2, wherein the device casing houses a power supply and the male contacts are electrically connected to the power supply.

* * * * *